US006393879B1

(12) United States Patent
William

(10) Patent No.: US 6,393,879 B1
(45) Date of Patent: May 28, 2002

(54) T-BAR DECK LOCKER SECURITY SYSTEM

(76) Inventor: J. Mark William, 4304 Whisperwood Dr., Raleigh, NC (US) 27616

( * ) Notice: Subject to any disclaimer, the term of this patent is extended or adjusted under 35 U.S.C. 154(b) by 0 days.

(21) Appl. No.: 09/595,132

(22) Filed: Jun. 16, 2000

(51) Int. Cl.[7] ..... E05B 73/00

(52) U.S. Cl. ..... 70/164; 70/57; 70/58; 70/163; 292/288; 292/289

(58) Field of Search ..... 70/57, 58, 158, 70/163, 164, 166–169, 209, 101, 14, 94; 292/259, 288, 289, 338, 339, 259 R

(56) References Cited

U.S. PATENT DOCUMENTS

| | | | | | |
|---|---|---|---|---|---|
| 4,827,864 | A | * | 5/1989 | LaMontagne et al. | 114/343 |
| 5,787,740 | A | * | 8/1998 | Huebner | 70/58 |
| 5,927,107 | A | | 7/1999 | Mitchell | 70/14 |
| 5,975,002 | A | | 11/1999 | Reiger | 114/343 |

* cited by examiner

*Primary Examiner*—William Cuchlinski, Jr.
*Assistant Examiner*—Marthe Y. Marc-Coleman

(74) *Attorney, Agent, or Firm*—Mills Law Firm PLLC

(57) ABSTRACT

A T-bar lockable linkage is deployed between the gunnels and forward seating or casting area of a marine craft and effective to limit opening of an array of side and central storage containers including a telescoping cross bar assembly that is connected to mounting brackets at the sides of the front boat deck. The mounting brackets include universal connectors that allow self alignment of the cross bar assembly, notwithstanding varying boat configurations or installation inaccuracies. The cross bar assembly includes a slotted slidable hub that may be aligned with a forward anchorage location, preferably an existing pedestal base for a swivel boat seat. The cross bar assembly includes matching holes aligned with a medial slot in the hub. A front anchor is releasably attached to the front pedestal base and slidably receives a center locking bar. With the center locking bar in place, the front anchor is conditioned against removal. The center locking bar is aligned with and closely overlies the center storage lockers and includes a terminal end that is received in the hub slot and a projecting locating pin that is received in the cross bar holes thereby limiting relatively movement therebetween and preventing disengagement from the mounting brackets. The hub carries a keyed locking device including a latch bolt that engages the center locking bar to unitize the assembly and prevent separation of the components.

14 Claims, 8 Drawing Sheets

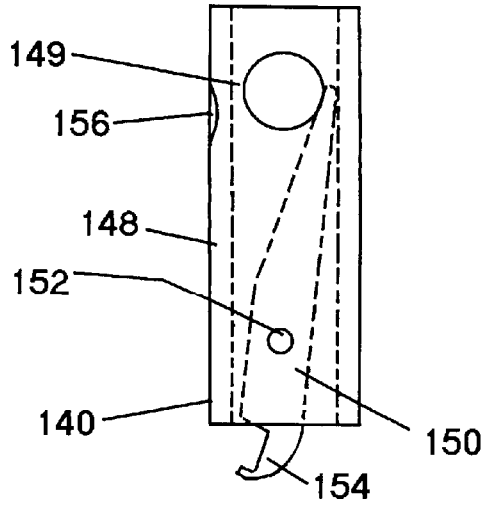
FIG. 13
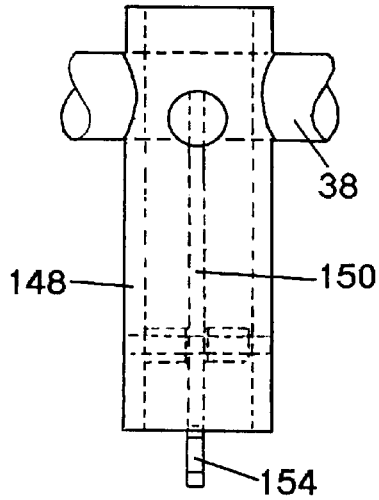
FIG. 14
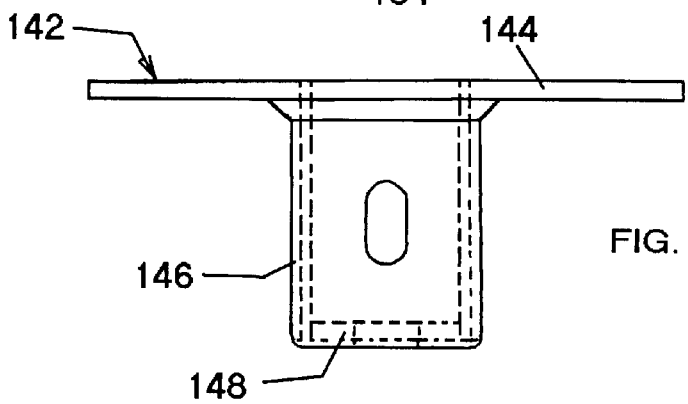
FIG. 15
FIG. 16
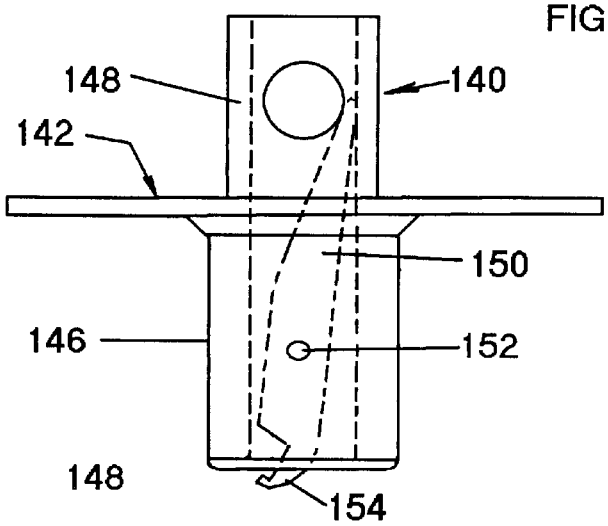

T-BAR DECK LOCKER SECURITY SYSTEM

FIELD OF THE INVENTION

The present invention relates to secured storage systems for marine craft and, in particular, to a security system kit for protecting the contents of storage lockers on the deck of a sport fishing boat.

BACKGROUND OF THE INVENTION

Recreational sport fishing is an extremely popular activity for many outdoor enthusiasts. Bass fishing in particular has an extensive following and many specialized marine products have been developed to assist the angler in pursuit of these selective, combative and challenging fish. Special craft know specifically as bass boats have been developed to take the angler to the varying environments of the bass and provide stable platforms for fishing. Additionally extensive, specialized gear and accessories have been developed for fully outfitting the boat and the angler for the activity.

Such gear generally includes a variety of poles and reels, specialized tools, tackle and lures, and bait, cooling and storage containers for the catch, life jackets, sporting attire and related paraphernalia that may be stored separately on board. However, all of the foregoing items are valuable and subject to pilferage when the boat is unattended, docked, transported or otherwise unattended. To provide greater organization and security, specialized lockable containers have become available. However, such individual containers are not readily stowed or organized compactly and efficiently. Moreover, the construction of such containers, usually lighter weight material such a plastics, does not provide substantial deterrence to pilferage. Increasingly, bass boat manufacturers and accessory supplies have provided customized, integrated storage lockers into the boat design. One example of such an approach is disclosed in U.S. Pat. No. 5,975,002 to Reiger wherein a plurality of fore and aft storage containers are integrated into the boat construction. Such containers include side containers adjacent the gunnels for rods and reels and center containers for tackle, lures, bait and catch. Generally, the containers are fabricated from plastic and covered by hinged or removable lids. While cover securing devices are employed, substantial deterrence to entry and theft is not afforded.

In order to provide greater deterrence to theft, more secure locking systems have been proposed. In U.S. Pat. No. 5,927,107 to Mitchell, a locking device comprising telescoping pipes is supported between fixed brackets on the gunnels of the boat. The pipes overlie the container lids and limit opening movement thereof to deter pilferage. The inner pipe includes a series of through holes. A padlock link is inserted through the hole nearest the outer pipe to prevent removal of the pipes from the brackets. While providing deterrence to theft from the side boxes, the proposed device required specialized mounting brackets to adapt to varying boat configurations. Moreover, unless accurately aligned, connection with the cross pipes was difficult. Additionally, the regular spacing of the locking holes can result in assembled conditions with sufficient side movement to reduce the capture of the cross pipes and facilitate dislodging of the device. Furthermore, the locking device is effective only against side containers and center containers directly beneath the cross pipes. Inasmuch as many boat designs include a plurality of center containers, the remainder are left unprotected.

In view of the foregoing limitations, a need continues to exist for a comprehensive, readily deployed security system for boat storage lockers that can accommodate widely varying boat designs and protect from theft and pilferage the angler's valuable possessions.

Accordingly it is an object of the present invention to provide a lockable security system for providing security to an array of storage lockets in a marine craft with a single device.

Another object of the invention is to provide a security system for storage lockers of marine craft that can be readily installed in boats of varying configurations.

A further object of the invention is to provide secure device for preventing unwanted access to side and center storage containers in bass boats.

Yet another object of the invention is to provide a storage locker security kit that may be custom installed on varying boat designs and is effective against pilferage of contents held in a plurality of side and center storage lockers.

SUMMARY OF THE INVENTION

The foregoing objects are achieved by a storage locker security system in accordance with the invention by T-bar lockable linkage deployed between the gunnels and forward seating or casting area of a marine craft and effective to limit opening of an array of side and central storage containers. More particularly the security system comprises a telescoping cross bar assembly that is connected to mounting brackets at the sides of the front boat deck. The mounting brackets include a universal connector that allows self alignment of the cross bar, notwithstanding varying boat configurations or installation inaccuracies. The cross bar assembly includes a slotted slidable hub that may be aligned with a forward anchorage location, preferably an existing pedestal base for a swivel boat seat. The cross bar assembly includes matching holes aligned with a medial slot in the hub. A front anchor is releasably attached to the front pedestal base and slidably receives a center locking bar. With the locking bar in place, the front anchor is conditioned against removal. The center locking bar is aligned with and closely overlies the center storage lockers and includes a terminal end that is received in the hub slot and a projecting locating pin that is received in the cross bar holes thereby limiting relatively movement therebetween and preventing disengagement from the mounting brackets. The hub carries a locking devices including a latch bolt that engages the center locking bar to unitize the assembly and prevent separation of the components. The resultant assembly is readily installed, without specialized skills, on site with simple equipment.

DESCRIPTION OF THE DRAWINGS

The above and other features and advantages of the present invention will become apparent upon reading the following detailed description taken in conjunction with the accompanying drawings in which:

FIG. 13 is a side elevational view of an embodiment of the anchor spindle;

FIG. 14 is side elevational view of anchor spindle of FIG. 13;

FIG. 15 is a side elevational view of another pedestal base; and

FIG. 16 is a side elevational view of the anchor spindle of FIG. 13.

DETAILED DESCRIPTION OF THE PREFERRED EMBODIMENTS

The present invention relates to storage security for marine craft and will be particularly described with reference to storage lockers for bass boats. However, it will be appreciated that the features, benefits and advantages of the storage security system will be afforded the varying types and sizes of bass boats and marine craft.

Figure 2:
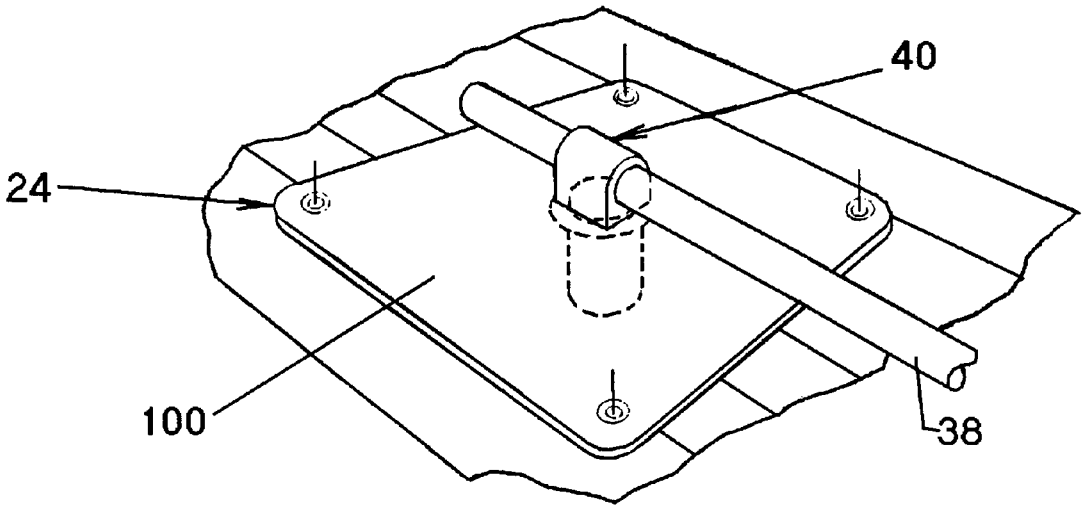
FIG. 2 is a fragmentary perspective view of the seat pedestal plate and anchor spindle of the deck locker security system shown in FIG. 1.
Figure 1:
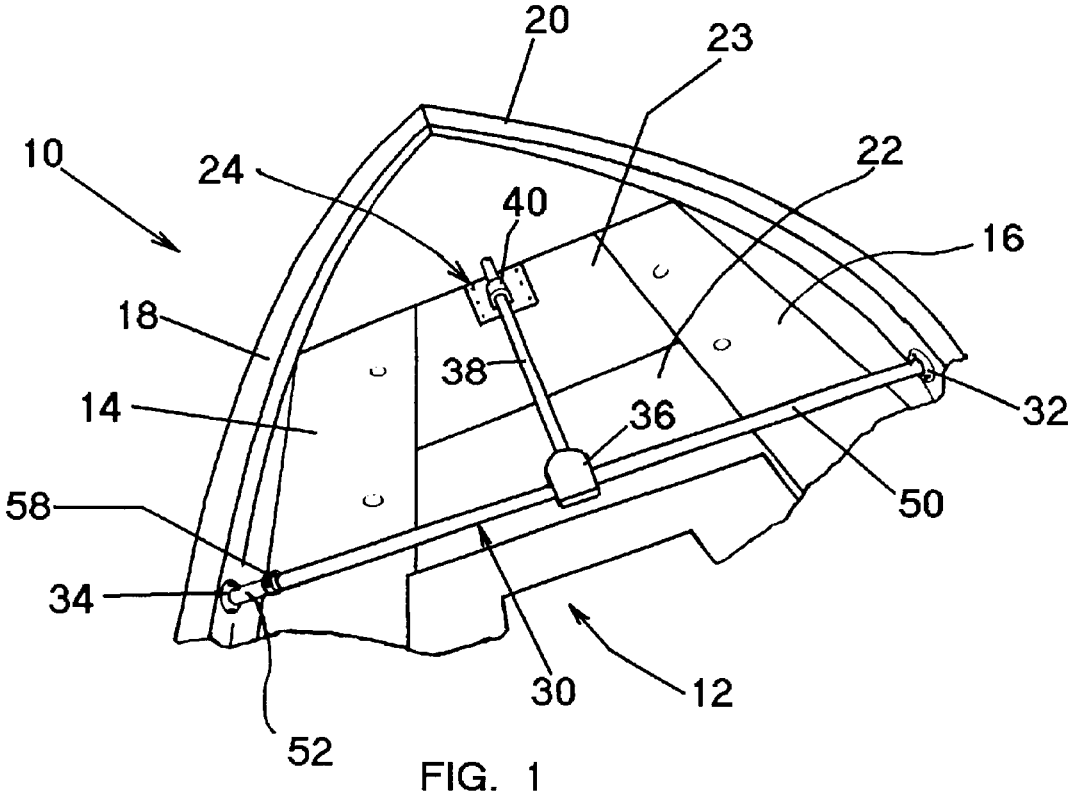
FIG. 1 is a partial perspective view of a deck locker security system in accordance with the present invention installed in the hull of a marine craft.

Referring to FIG. 1, a bass boat 10 is provided with a T-bar deck locker security system 12 for limiting access to a plurality of covered storage containers in the hull of the boat including side lockers 14 and 16 located along the sides adjacent the gunnels 18 and 20, and center lockers 22 and 23 located therebetween. The illustrated boat is provided with a conventional removable swivel seat, not shown, operatively mounted at a front seat pedestal base 24 in the bow. As described below, the pedestal base may used in conjunction with an embodiment of the security system, however, or a separate frontal assembly may be alternatively employed.

The side lockers 14 and 16 are used primarily for housing and securing rods and tackle whereas the center locker 22 may be used for bait and game fish and supplies therefor. Inasmuch as the contents of the lockers are valuable and subject to pilferage, the security system 10 is deployed during docking, transporting or other times when the boat is unattended.

More particularly, the security system 10 comprises a lateral cross bar assembly 30 closely overlying the side lockers 14, 16 and connected to side swivel brackets 32, 34 fixedly attached to the gunnels 18, 20 respectively, a latching hub 36 carried on the cross bar assembly 30, and a center bar 38 releasably coupled at in inner end to the latching hub 36 and slidably connected at the outer end to a anchor spindle 40 removably carried at the pedestal base 24. The center bar 38 overlies the center locker 22. The security system 10, as deployed, is sufficiently closely adjacent the locker covers, whether hinged or removable, to prevent the opening thereof sufficiently to gain access to the stored contents thereof. Preferably the cross bar assembly bisects the side lockers 14, 16 and the center bar 38 bisects the center locker 22. As hereinafter described in detail, the security system 10 may be readily deployed and latched for securing the lockers as desired, and readily disassembled and stowed during fishing excursions.

Figure 4:
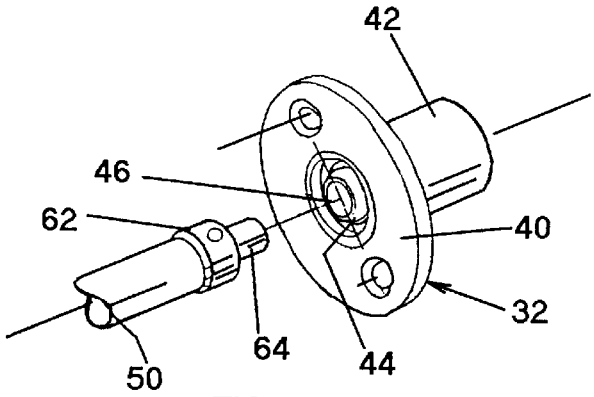
FIG. 4 is a fragmentary perspective view of the side swivel bracket for the cross bar assembly.

The cross bar assembly 30 is transversely disposed with respect to the keel of the boat 10 and removably fixedly connected with the brackets 32, 34. Each bracket is similar in construction. The bracket 32, for illustrative purposes as shown in FIG. 4, includes a circular front mounting plate 40 and a rear cylindrical sleeve 42. A spherical bearing 44 is socketed within the sleeve 42 in a conventional manner for universal movement with respect thereto.

The cross bar assembly 30 comprises an elongated outer cylindrical outer sleeve 50 telescopically supporting an inner circular shaft 52. The sleeve 50 and the shaft 52 may axially relatively shifted for extending or shortening the overall length of the cross bar assembly 30. The outer end of the shaft 52 is provided with an enlarged end cap 54 terminating with a projecting circular stem 56. The stem 56 is adapted to be slidably received within the bore 46 of the bearing 44. The inner end of the outer sleeve 50 is provided with a stop collar 58 that engages an appropriate stop surface on the inner end of the shaft 52 to prevent separation of the components after assembly. Referring to FIG. 4, the outer end of the outer sleeve 50 is provided with an end cap 62 having a projecting stem 64 similarly slidably received within the bore 46 of the bearing 44 of the associated bracket. The outer sleeve 50 is provided with a plurality of axially spaced aligning holes 70 for purposes described below.

In assembly, the selected transverse orientation of the cross bar assembly 30 is determined and a blind hole is formed in the gunnel for receiving the sleeve 42 of the associated bracket. The mounting plate of the bracket is provided with mounting holes for fixedly securing the bracket to the gunnels by suitable fasteners. It will accordingly be appreciated that in assembly the bar assembly will be self-centered with respect to the brackets, universal accommodating movement being provided by the ability of the spherical bearing to freely rotate to the orientation of the stems. With the brackets mounted on the gunnels, the shaft and the outer sleeve may be outwardly telescoped until the stems are securely seated in the bearings and the center bar assembly firmly supported between the brackets and overlying the selected locker doors to be secured. Such accommodation further permits a standard mounting plate to be used regardless of the curvature of the gunnels at the mounting area. Accordingly, the misalignment, abuse, and premature wear occasioned by fixed point connectors is avoided.

Figure 3:
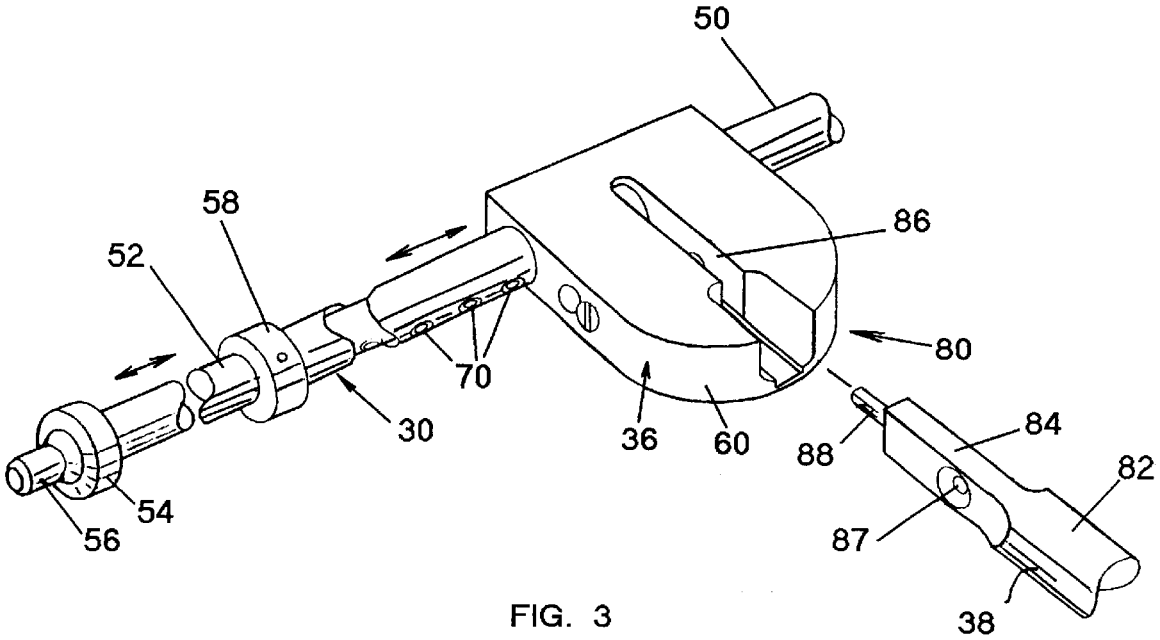
FIG. 3 is a fragmentary perspective view of the hub assembly of the security system.
Figure 5:
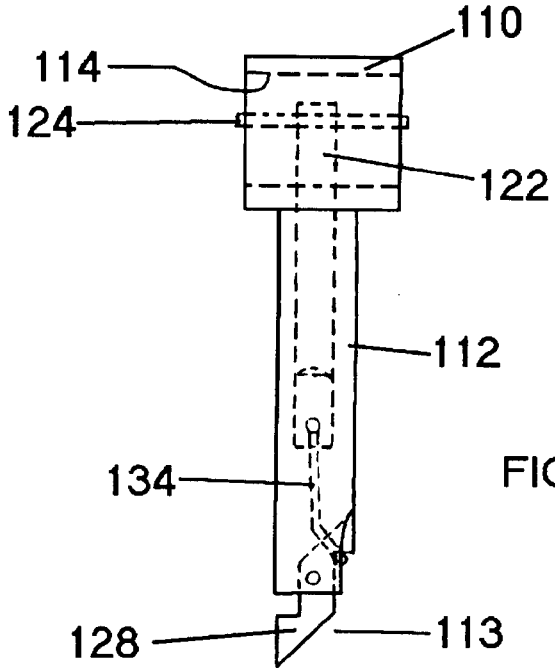
FIG. 5 is a side elevational view of the anchor spindle for the pedestal bracket in the open position.
Figure 6:
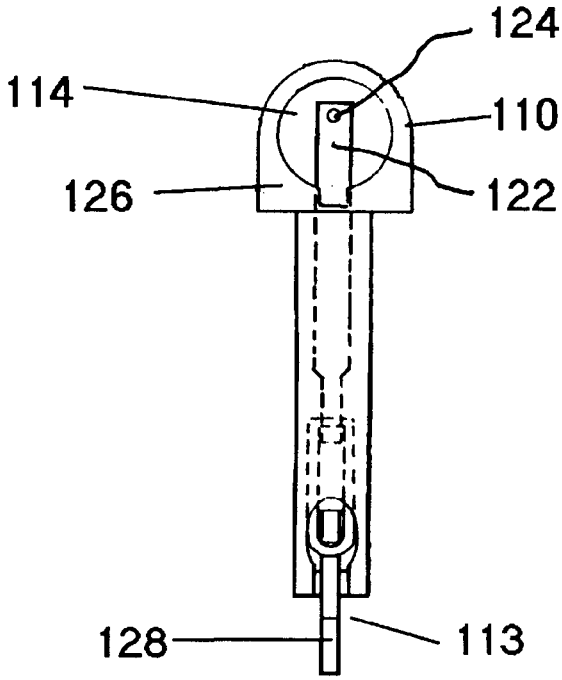
FIG. 6 is a front elevational view of the anchor spindle shown in FIG. 5.
Figure 11:
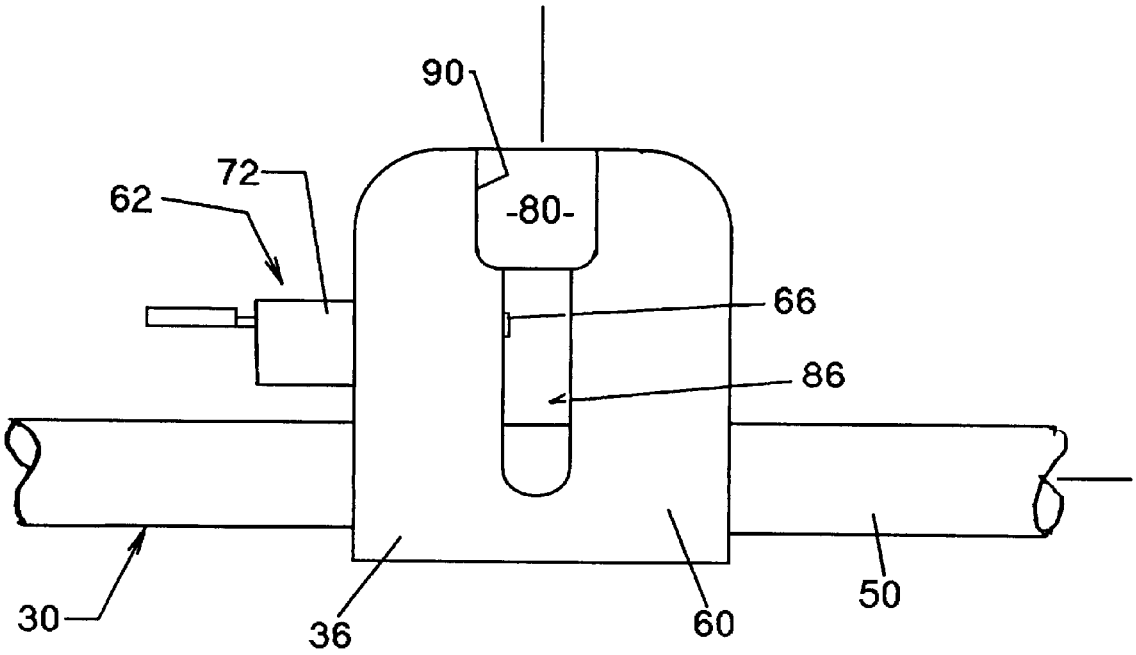
FIG. 11 is a bottom view of the hub and cross bar assemblies in the unlocked condition.
Figure 12:
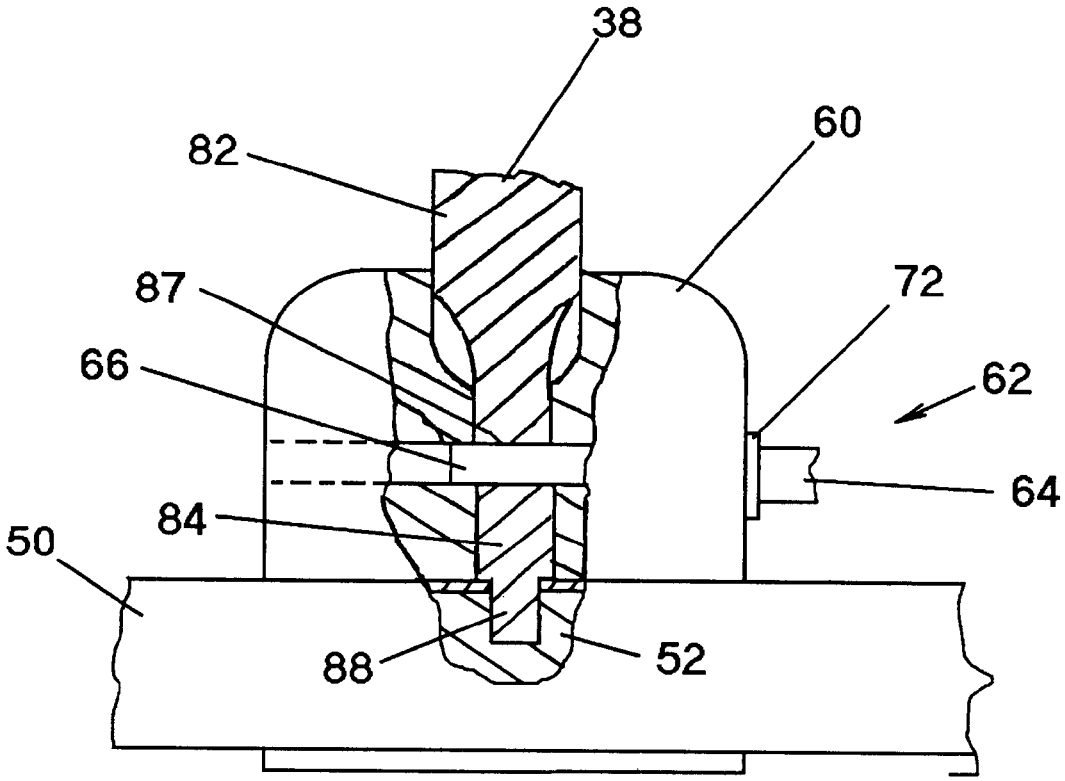
FIG. 12 is a bottom view of the hub and cross bar assemblies in the locked condition.

Referring to FIGS. 3, 11 and 12, the hub 36 is slidably carried on the outer sleeve 50 and comprises a lock block 60 and a lock assembly 62 accepting a locking key 64 and operative to transversely shift a lock bolt 66. The rear end of the block 60 includes a transverse through bore for slidably receiving the outer sleeve 50 of the cross bar assembly 30. The lock assembly 62 may take various forms of key activated linear bolt actuation. A commercially available billet type lock is preferred. The lock assembly body is recessed in a correspondingly shaped blind hole formed in one side of the block. The lock bolt 66 is operatively coupled to the lock assembly and slidably aligned with a transverse through hole 70. In the unlatched condition, lock barrel 72 projects laterally outwardly of the block 60. With the key 64 inserted into the keyhole, the barrel is depressed to shift the lock bolt 66 to the locked condition. Thereafter, the key is appropriately rotated to maintain the locked position relationships.

The hub 60 includes a forwardly and downwardly opening support slot 80 for conformably slidably supporting the inner end 82 of the center bar 38. The inner end 82 of the center bar 38 is laterally narrowed to form an alignment tongue 84 that is received within a conformal tongue portion 86 of the slot 80. The tongue 84 includes a chamfered transverse hole 87 for receiving the lock bolt 66. The outer portion 90 of the slot 80 has conformal surfaces for locally supporting the sides of the center bar 36. The inner end 82 terminates with a projecting circular locating pin 88. The locating pin 88 is configured to project through aligned holes in the inner shaft 52 and outer sleeve 50. To this end for custom assembly, the cross bar assembly is mounted at the brackets. Thereafter, the hub 60 is axially shifted along the outer sleeve 50 to the desired alignment for the center bar 38 and aligned axially and circumferentially with the preformed hole 70 in the sleeve 50 closest thereto. This location is then transcribed to the inner shaft 52. The cross bar assembly 30 is thereafter extended and a through or blind hole drilled into the inner shaft 52 at the inscribed location. Subsequent retraction to align appropriately the slot 80 with the holes will allow the pin of the center bar to enter the aligned apertures thereby preventing relative axial movement and retaining the cross bar assembly on the brackets. With the end surface of the inner end of the center bar engaging the outer sleeve a chamfered through hole 94 on the tongue will be aligned with the lock bolt such that actuation of the lock assembly to the latched condition will releasably retain the center bar on the hub. In this connection it will be appreciated that the inner shaft could be provided with a preformed series of holes provided the incremental aligned positions would ensure retention of the bar assembly at the brackets. Further, neither component need be preformed and both the sleeve and the shaft could be custom drilled on-site. Moreover, with a sufficiently long drill bit, the components may be drilled with the hub in the installed position.

After installation of the cross bar assembly, the outer end of the control bar is slidably received through the anchor spindle 40 prior to latching as described below. The center bar 38 is rearwardly shifted into the slot 80 until the locating pin 88 enters the holes and the lock bolt 66 actuated. Thereafter, the security system 10 overlies the lockers 14,16, 22 and 23 preventing access to the contents thereof.

Figure 7:
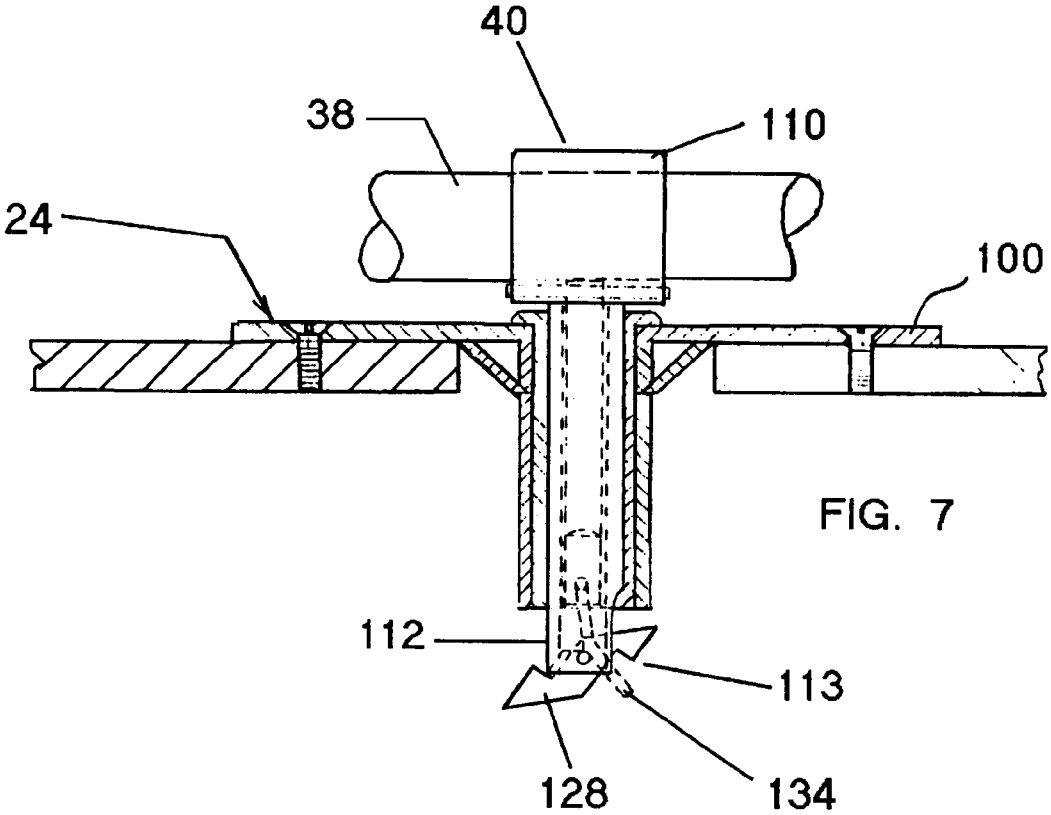
FIG. 7 is a side elevational view of the anchor spindle and center bar in assembly and illustrating the installed condition.
Figure 8:
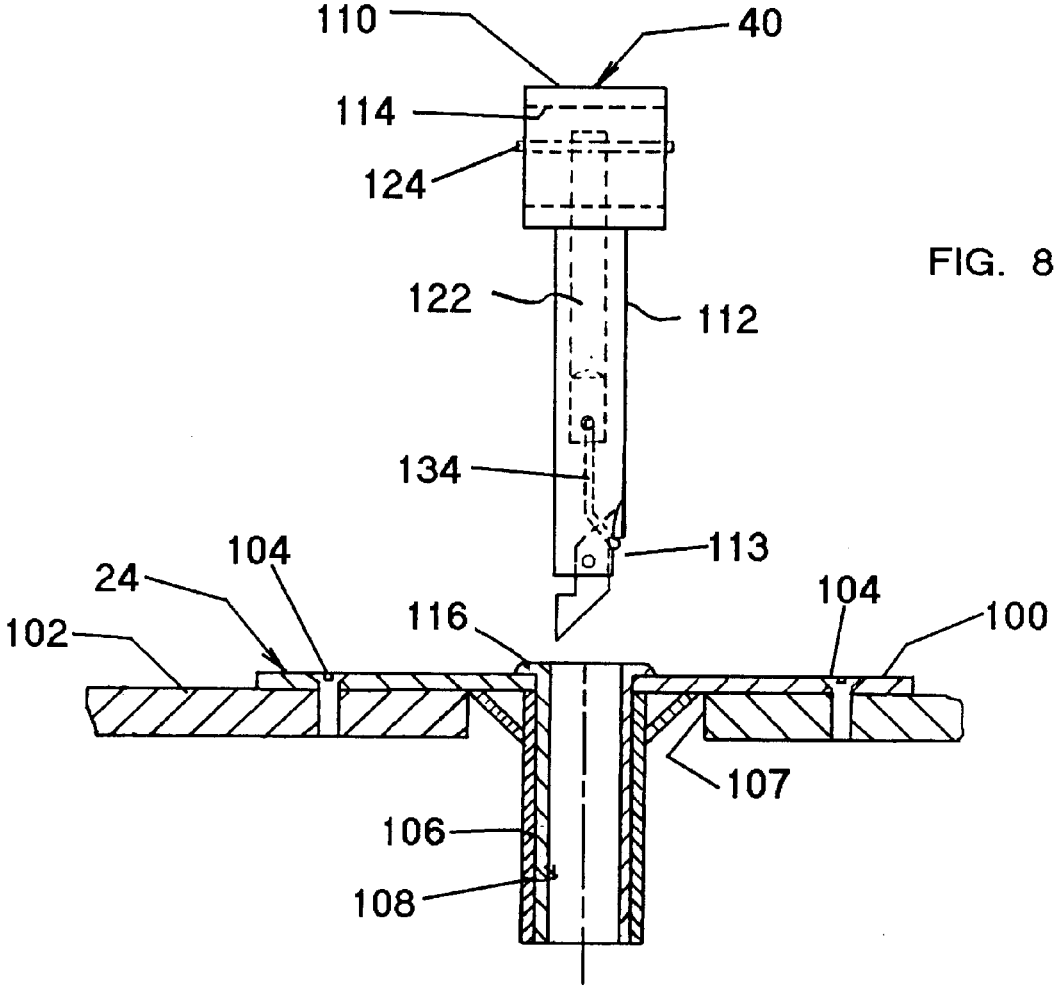
FIG. 8 is a side elevational view of the mounting spindle in the insertion position with respect to the pedestal base.

In the preferred embodiment the front anchor spindle is adapted to be used in connection with the existing front pedestal mounts for frontally mounted removable seats commonly used in bass boats. Referring to FIGS. 7 and 8, the mounting pedestal base 24 for such an installation, includes a rectangular mounting plate 100 fastened to the foredeck 102 of the boat by a plurality of fasteners 104. The mounting plate 100 is centrally apertured and a post sleeve 106 fixedly connected to the lower surface thereof. The sleeve 106 extends through a corresponding opening 107 in the fore deck 102. The sleeve 106 includes an inner bushing 108 having a vertically extending through bore for accepting a lower post on the swivel seat. With the seat removed, the mounting anchor spindle of the present invention is adapted to be releasably seated at the pedestal base for alignment with and reception of the center bar 38.

Referring to FIGS. 5 through 9, the anchor spindle 40 comprises an upper journal body 110 and a lower latching sleeve 112 including a latching assembly 113. The journal body 110 includes a horizontal longitudinal cylindrical passage 114 for telescopically receiving the center bar 38. The journal body 110 includes a lower planar surface for engaging the annular head 116 of the bushing 108. The latching sleeve 112 is rotatably and slidably received in the bushing. The latching assembly 113 includes an internal actuating arm 122 carrying a cross pin 124 extending through the passage 114 in the journal body 110 and resides in a lower slot 126 at the bottom of the passage in the latched condition. A generally Z-shaped locking tab 128 is pivotally connected to the arm 122 by link 134. An axial slot is formed in the lower portion of the body aligned with the tab 128. The tab 128 is rotatable between the insertion position shown in FIG. 8 and the latched condition shown in FIG. 7. In the unlatched position, the tab 128 is aligned vertically within the envelope of the body permitting insertion of the spindle on the mounting plate. In the latched condition, the tab is transverse to the body and the stop surfaces 130, 132 on the tab 128 project outwardly of the bushing thereby locking the mounting spindle. The tab 128 is shifted between the latched condition and the unlatched condition by actuating linkage 130. The linkage in the raised position interacts with the tab for vertically orienting the tab. In a lowered position, the linkage rotates the tab to the transverse latched condition to prevent spindle withdrawal.

In another embodiment shown in FIGS. 13 through 16, the mounting anchor spindle 140 may be used in conjunction with another available pedestal base 142 having a base plate 144 for attachment to the deck, and a downwardly projecting sleeve 146 having an annular rim 148 at the base thereof. The spindle 140 includes a tubular body having a cross hole 149 for slidably receiving the center bar 38. A latching arm 150 is interiorally pivotally supported at the lower end of the body 148 by cross pin 152. The latching arm 150 downwardly terminates with a notched latch tab 154. Access holes 156 are formed in the body 148 for manually pivoting the arm 150. For assembly, the spindle 140 is lowered into the sleeve and the latching arm 150 manipulated to allow the latching tab to pass beyond the rim. Thereafter the arm is pivoted to the position shown in FIG. 16 wherein the tab overlies the rim 148 and the spindle is latched against removal from the bracket. Insertion of the center bar 38 prevents the locking arm from returning to the released position thereby preventing removal of the spindle in the enabled condition of the security system.

Figure 10:
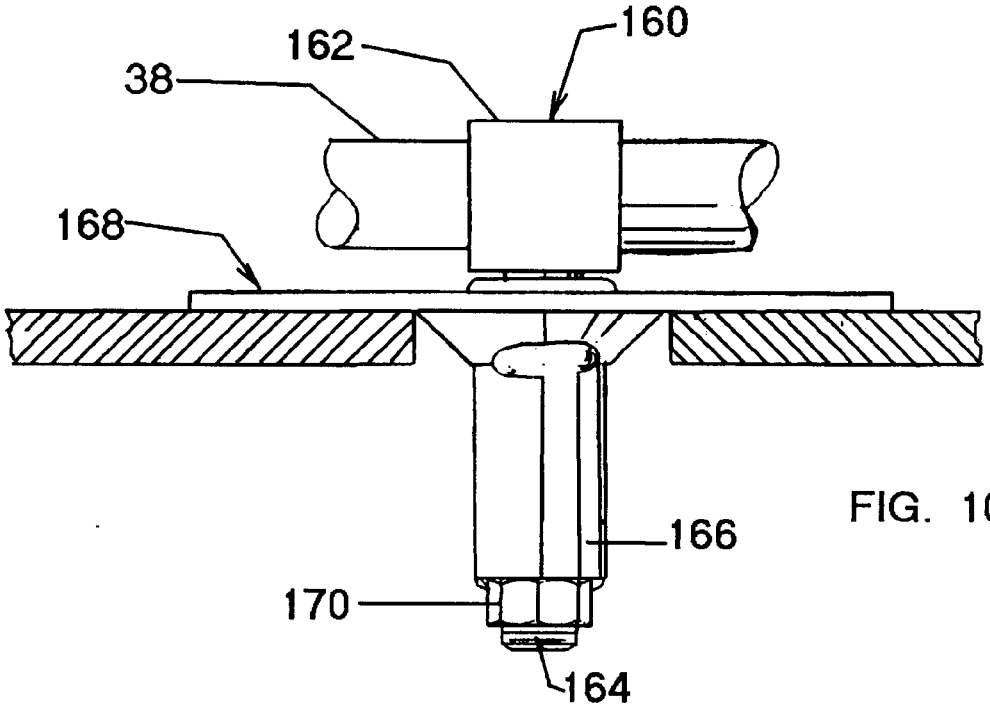
FIG. 10 is a fragmentary side elevational view of another embodiment of the seat pedestal assembly in the installed condition.
Figure 9:
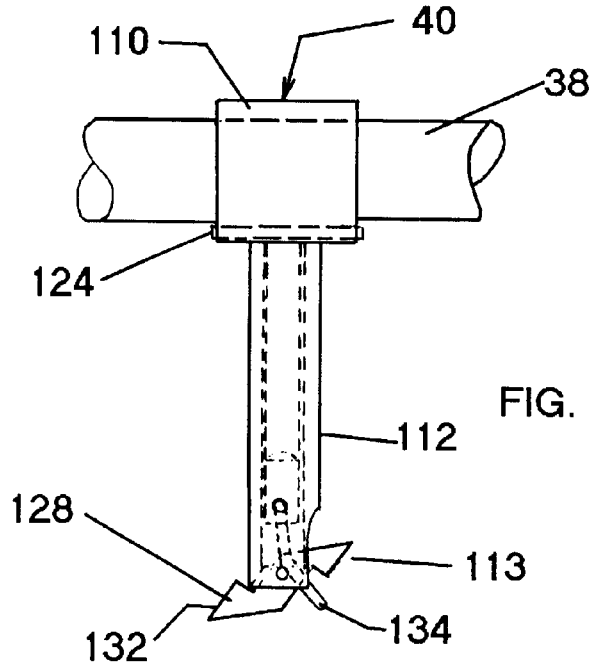
FIG. 9 is a fragmentary side elevational view of the seat pedestal assembly in the installed condition.

A further spindle embodiment is shown in FIG. 10 wherein the anchor spindle 160 includes an upper journal body 162 having a central passage for receiving the center bar 38 and a lower threaded post 164 extending though the mounting bracket sleeve 166 of the base 168 and fixedly clamped thereto by nut 170 welded to the sleeve 166. The anchor is appropriately threaded onto the nut 170 and aligned with the hub 60 for assembly. This embodiment is advantageous for those boat designs and security systems utilizing the seat bracket for the forward anchorage.

All of the foregoing embodiments of the storage locker security system may be incorporated into the original manufacture of the bass boats or preferably available in kit form adaptable to the full range of locker layouts for the various marine craft and sport fishing boats having discrete containers for sporting gear. In kit form, the security systems is provided with the cross bar assembly, the universal side mounting brackets, the connector hub, the center bar, and center bar spindle together with associated fasteners and materials.

In typical installation, the installer determines the desired position for lateral cross bar assembly in order to properly overlie the side lockers 14, 16. The location for the fasteners and mounting sleeve noted, the associated holes therefor drilled in the gunnels and the side brackets mounted thereat. Next the center bar assembly is extended and mounted on the side brackets and the connector hub moved to a central position aligned with the forward anchorage point at the seat mounting plate. The hub is aligned on the outer sleeve closest to the aligned location, the inner shaft noted and drilled for reception of the locating plug on the center bar. The forward spindle is inserted into the seat mounting plate bore and conditioned against removal. Thereafter, the outer end of the center bar is inserted through the spindle passage and the inner end roughly positioned in the slot in the hub connector. Aligning the openings in the outer sleeve and the inner shaft with the slot, the center bar is shifted toward the outer sleeve until the locating plug is firmly seated with the lock bolt aligned with the cross hole in the tongue. When the key is actuated, the deployed cross bolt locks the components together to establish a rigid secure structure preventing access to the stored contents. The deployed security system may be removed in reverse sequence and stowed on the boat or elsewhere.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A security system for a boat having a pair of gunnels and a seat bracket for a removable seat, said boat having side storage compartments members located adjacent to and between the gunnels and central storage compartment members located between the side storage compartment members, said security system for preventing unauthorized access to the storage compartment members comprising: a mounting bracket for connection with each gunnel and located in opposed transverse relation, each said mounting bracket having a pivotal member thereon; transverse security means including first and second telescoping members having terminal ends connected to said pivotal members and thereat closely overlying said side storage compartment members; a hub member carried by said transverse security means; lock means carried by said hub member; central security means for releasably connection at one end with said seat bracket and carried at said hub member at the other end and thereat closely overlying said center storage compartment members; and connector means operative between said hub member and said lock means for fixedly connecting the other end of said center security means to said hub member in a locked condition.

2. The security system as recited in claim 1 wherein said other end of said center security means engages said transverse security means to prevent removal of said transverse security means from said mounting brackets.

3. The security system as recited in claim 2 wherein said hub member includes a transverse passage for slidably receiving said transverse security means.

4. The security system as recited in claim 3 wherein said telesopic members include an elongated outer cylindrical sleeve and an elongated inner cylindrical shaft telescopically supported by said outer cylindrical sleeve, and said center security means includes an elongated circular center bar.

5. The security system as recited in claim 4 wherein stop means cooperate between said shaft and said sleeve to prevent separation therebetween.

6. The security system as recited in claim 4 wherein an anchor member is slidably connected with said one end of said center bar and includes latching means for releasable connection with said seat bracket.

7. The security system as recited in claim 6 wherein said hub member includes a downwardly opening slot aligned with said seat bracket and said other end of said center bar has a terminal portion slidably received in said slot.

8. The security system as recited in claim 7 wherein said terminal portion includes a transverse hole and said locking means includes a lock bolt engaged with said terminal portion at said transverse hole in said locked condition.

9. The security system as recited in claim 6 wherein said latching means of said anchor member provides a latched condition when operatively associated with said center bar and a unlatched condition when separated from said center bar.

10. The security system as recited in claim 9 wherein said seat bracket includes an apertured support sleeve and said anchor includes a spindle carried by said support sleeve with said latching means engaging said support means in said latched condition for preventing removal of said anchor member from said seat bracket when said center bar is operatively connected therewith.

11. The security system as recited in claim 1 wherein said telescopic members have aligned positioning apertures in said mounted position and said terminal portion includes projecting pin means received in said apertures preventing relative movement between said telescopic members in said locked condition.

12. The security system as recited in claim 1 wherein said pivotal member is a spherical ball universally supported on said mounting bracket and having a central passage therethrough and said end of each of said telescopic members is received in said central passage for universal connection with said mounting bracket.

13. In a marine craft having a plurality of storage lockets carried therein including side lockers located adjacent to the sides of the boat and center storage lockers located between said side lockers, and a forward seat pedestal base located transversely between said side lockers and beyond said center lockers, a T-bar security system for preventing access to said lockers in a locked condition comprising: a first mounting bracket mounted on one side of said marine craft and a second mounting bracket mounted on the other side of said marine craft in transverse opposed relation to said first mounting bracket; a spherical connector member carried by each mounting bracket and universally rotatable with respect thereto; a center support assembly including an outer cylindrical sleeve and an inner cylindrical shaft carried by said sleeve and axially adjustable with respect thereto; a first connector at the outer end of said sleeve connected to said spherical member on said first mounting bracket; a second connector as the outer end of said shaft connected to said spherical member on said second mounting bracket; a connector hub slidably adjustably carried by said outer sleeve; a passage in said connector hub having one end at said sleeve and another end aligned with said pedestal base at a locking position; an anchor member for releasable connection with said pedestal bracket; a center bar connected at one end to said anchor member and at the other end to said connector hub; first locking means operative between said connector hub and said center bar for maintaining a connected relation therebetween in said locked condition; and second locking means carried by said connector hub for preventing axial movement between said outer sleeve and said inner shaft in said locked condition.

14. A kit for securing storage lockers on a bass boat comprising: a pair of mounting brackets adapted to be connected to the sides of the boat, each bracket including a universally supported spherical connecting member; an elongated center support sleeve having an outer end adapted to be releasably connected with said spherical connecting member; an elongated center support shaft adapted to be telescopically supported by said support sleeve, said shaft and said sleeve and having outer ends adapted to be releasably connected with said spherical connecting member; a hub member adapted to be carried by said support sleeve; an anchor member adapted to be connected to said boat between the sides of said boat and remote from said mounting brackets; an center member having a first end for connection with said anchor member and a second end for connection with said hub member; a lock member carried by said hub member and engagable with said second end of said center member for preventing separation of said center member from said hub member; connector means carried on said hub member and operatively connected to said lock member for fixedly connecting the other end of said center bar to said hub member.

* * * * *

UNITED STATES PATENT AND TRADEMARK OFFICE

CERTIFICATE OF CORRECTION

PATENT NO. : 6,393,879 B1
DATED : May 28, 2002
INVENTOR(S) : J. Mark Williams

It is certified that error appears in the above-identified patent and that said Letters Patent is hereby corrected as shown below:

Title page,
Item [75], please change the inventor's last name to -- Williams --

Signed and Sealed this

Twenty-third Day of July, 2002

*Attest:*

*Attesting Officer*

JAMES E. ROGAN
*Director of the United States Patent and Trademark Office*